US006533497B2

(12) United States Patent
Gunter

(10) Patent No.: US 6,533,497 B2
(45) Date of Patent: Mar. 18, 2003

(54) METHOD OF USING A TRENCH FORMING ASSEMBLY HAVING REMOVABLE PIN ANCHORING MECHANISM

(75) Inventor: Charles E. Gunter, Mooresville, NC (US)

(73) Assignee: ABT, Inc., Troutman, NC (US)

( * ) Notice: Subject to any disclaimer, the term of this patent is extended or adjusted under 35 U.S.C. 154(b) by 0 days.

(21) Appl. No.: 10/172,964

(22) Filed: Jun. 17, 2002

(65) Prior Publication Data

US 2002/0154952 A1 Oct. 24, 2002

Related U.S. Application Data

(62) Division of application No. 09/821,986, filed on Mar. 30, 2001, now Pat. No. 6,443,656.

(51) Int. Cl.[7] ..... E02B 5/08

(52) U.S. Cl. ..... 405/118; 405/36; 404/4; 403/308; 403/324

(58) Field of Search ..... 405/36, 43, 118, 405/119; 404/2–5; 403/306, 308, 324

(56) References Cited

U.S. PATENT DOCUMENTS

| | | | | |
|---|---|---|---|---|
| RE26,366 E | | 4/1968 | Flegel | 404/2 |
| 3,634,989 A | | 1/1972 | Rogers | 403/306 |
| 3,674,149 A | | 7/1972 | Donalson | 210/163 |
| 4,711,603 A | | 12/1987 | Rippe, Jr. et al. | 405/230 |
| 4,776,639 A | | 10/1988 | Braun et al. | 299/108 |
| 4,952,094 A | | 8/1990 | Spiess et al. | 405/36 |
| RE33,439 E | | 11/1990 | Thomann et al. | 404/2 |
| 5,024,550 A | | 6/1991 | Mainville | 404/4 |
| 5,110,235 A | | 5/1992 | Thomann et al. | 404/4 |
| 5,281,051 A | | 1/1994 | Stegall | 405/118 |
| 5,281,052 A | | 1/1994 | Beamer | 404/4 |
| 5,399,047 A | | 3/1995 | Stegall | 405/119 |
| 5,437,516 A | | 8/1995 | Sauerwein et al. | 404/2 |
| 5,462,382 A | | 10/1995 | Sauerwein et al. | 404/2 |
| 5,466,091 A | | 11/1995 | Sauerwein et al. | 405/36 |
| 5,468,096 A | | 11/1995 | Sauerwein et al. | 405/36 |
| 5,478,169 A | | 12/1995 | Stegall | 405/119 |
| 5,522,675 A | | 6/1996 | Gunter | 405/118 |
| 5,564,860 A | | 10/1996 | Amann | 405/118 |
| 5,702,204 A | | 12/1997 | Gunter | 405/119 |
| 5,890,839 A | * | 4/1999 | Gunter | 405/119 |
| 6,220,784 B1 | | 4/2001 | Bricker | 405/118 |

FOREIGN PATENT DOCUMENTS

| | | |
|---|---|---|
| GB | 2 233 016 A | 1/1991 |
| GB | 2 234 001 A | 1/1991 |
| GB | 2 279 981 A | 1/1995 |

* cited by examiner

*Primary Examiner*—Thomas B. Will
*Assistant Examiner*—Tara L. Mayo
(74) *Attorney, Agent, or Firm*—Alston & Bird LLP

(57) ABSTRACT

An assembly for forming a trench comprising a frame having two elongated members that define a support surface and at least one opening. The assembly also includes a removable grate that is disposed on the support surface and includes a hook that is disposed proximate the opening defined by the elongated frame members. The assembly also includes a removable pin that is slidably inserted through an opening defined by an elongated member and is mechanically engaged by the hook of the grate to secure the grate to the frame.

8 Claims, 13 Drawing Sheets

10
45
40
15
14
41
52
44
15
52
14
22
38
22
13
12
3B
12C
12C
12B
43
30
42

40

14
17
34
41
30
31
37
32
36
33
42

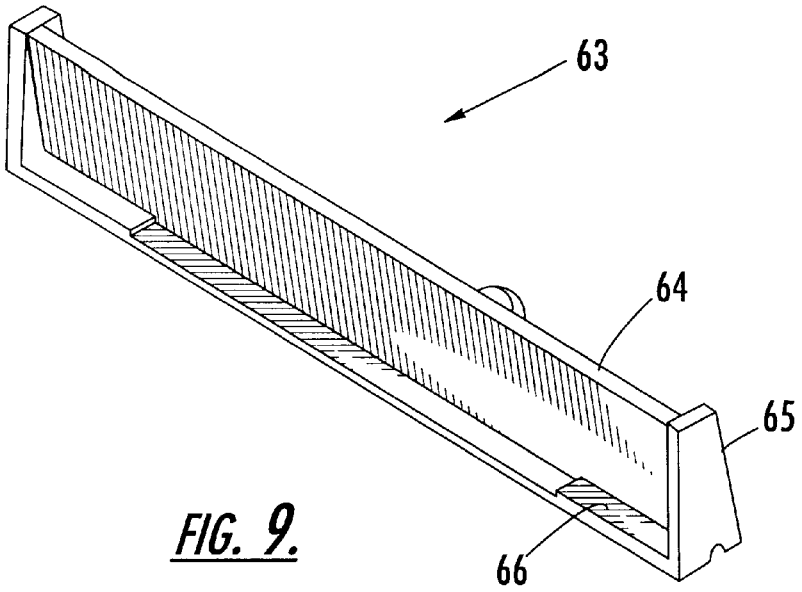
FIG. 9.
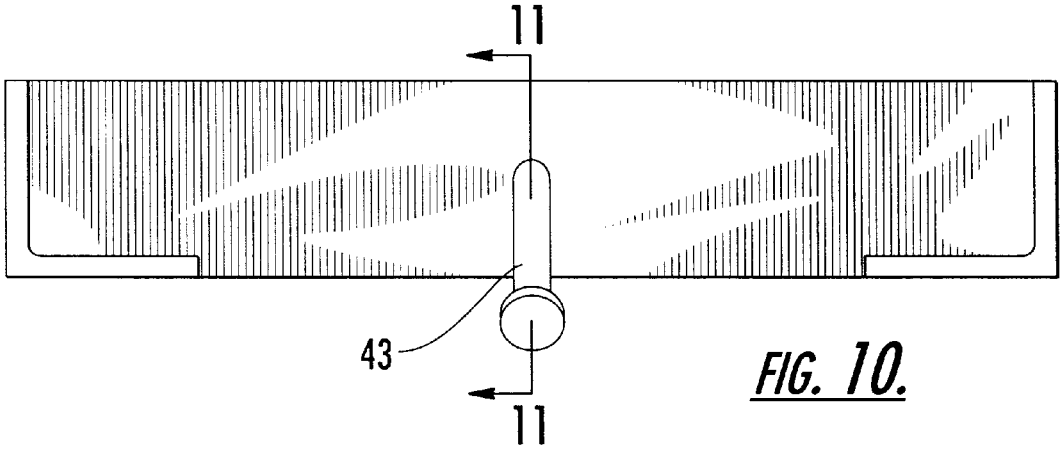
FIG. 10.
FIG. 11.
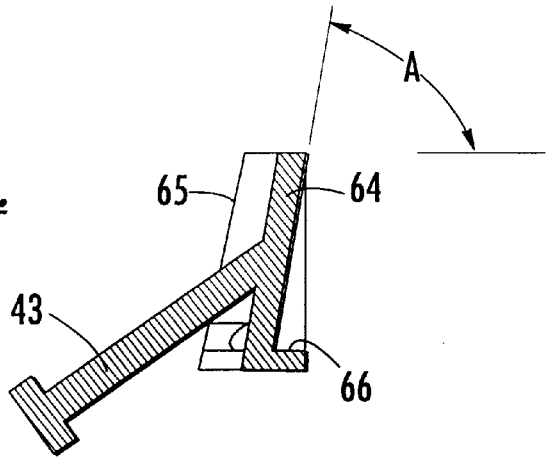

METHOD OF USING A TRENCH FORMING ASSEMBLY HAVING REMOVABLE PIN ANCHORING MECHANISM

CROSS-REFERENCE TO RELATED APPLICATION

This application is a divisional of U.S. application Ser. No. 09/821,986, filed Mar. 30, 2001, now U.S. Pat. No. 6,443,656, which is hereby incorporated in its entirety by reference.

FIELD OF THE INVENTION

The present invention relates generally to drainage systems and, more particularly, to a drainage channel or trench having a removable pin securing a grate spanning the trench.

BACKGROUND OF THE INVENTION

Drainage and other trenches of various sizes and shapes are desirable for a number of applications. For example, manufacturing facilities typically require drainage systems that include trenches formed in the building floors to collect, remove, and/or recycle excess water or other liquids. In addition, numerous outdoor industrial and commercial sites, such as parking lots, require drainage systems, including trenches, to collect and direct rainwater and other liquids to underground storm sewers to prevent flooding and to decrease run-off. Similarly, roadways and the like may also require drainage systems, including trenches.

In the past, these trenches have generally been formed by first placing and securing a form of predetermined shape in a ditch that has previously been formed in the ground. A moldable trench forming composition, such as cementitious material, is then poured around the form and is allowed to set. Once the cementitious material has set, the form is removed from the resulting trench.

One type of form assembly used to define a trench includes a wooden form and strut structure. The wooden form includes a wooden frame which is covered with wooden sheets or planks to define a generally rectangular elongated trough. The wooden form is typically enclosed along its side and bottom faces, but may have an open top. Typically, a number of supporting wooden ribs are installed within the wooden form to increase the strength of the form so that it can withstand the relatively large pressures exerted by moldable trench forming compositions poured about it.

The wooden form is placed and secured within a preformed ditch. Cementitious material is typically poured up to the bottom face of the form and allowed to set in order to anchor the wooden form in the ditch. Then additional cementitious material is poured between the earthen walls of the ditch and the wooden sides of the form. Once all of the cementitious material has set, the wooden form is disassembled and removed from the trench.

Wooden forms are generally formed of lumber having a relatively rough exterior texture. Correspondingly, the inside surface of the trench formed by the wooden form is relatively uneven which reduces the efficiency of the flow of liquid through the trench. In addition, the assembly and disassembly of the wooden forms is both costly and labor intensive. The relatively large cost and labor required for assembly and disassembly of the wooden forms is increased in the formation of long trenches, and even further increased in the formation of trenches having a pitched or slanted bottom surface to facilitate drainage.

Commercially significant methods for forming trenches, together with improved removable forms for forming trenches, are disclosed in U.S. Pat. No. 5,281,051, which is assigned to the assignee of the present invention and incorporated herein by reference. In advantageous embodiments thereof, inexpensive forms are employed to form trenches instead of using the wooden forms discussed above. The trench forming assembly disclosed in U.S. Pat. No. 5,281,051 preferably includes opposing longitudinal frame members having a plurality of anchoring rods extending downwardly from the frame members. An elongated form body, preferably formed of relatively lightweight expanded polystyrene, includes aligned longitudinal slots in the opposed side walls for receiving the frame members. Horizontal portions of the frame members are secured within the longitudinal slots in the sidewalls of the form body during formation of the trench so that the frame members are held in alignment during the trench forming operation. In typical practice, one or more wires are wrapped around the outside of the form body and frame members to hold the frame members in the slots of the form.

Preferably the assembled form and frame members are placed into a prepared ditch by suspending the assembly from its top. Cementitious material is first poured around the bottom of the anchoring legs attached to the frame members and allowed to set in order to anchor the anchoring legs and, in turn, the frame members and the form within the ditch. Then more cementitious material is poured around the form body and allowed to set. Finally the form body is removed to expose the resulting trench and the properly aligned frame members. The removal of the form may be facilitated by a pair of slots extending upwardly into the form body from its bottom surface. By removing an upper portion of the form to access the slots as shown in U.S. Pat. No. 5,281,051, the form body can be more easily removed from the trench in several pieces.

Regardless of the fabrication technique, it is normally desirable to finish the trench with an elongated grate covering its open top in order to prevent people from unwittingly stepping in the open trench, to provide a smooth surface for vehicle travel, and/or to prevent relatively large objects from entering the trench and potentially blocking the flow of liquid therethrough. For a trench formed and described by U.S. Pat. No. 5,281,051, the grate is generally supported by a pair of spaced apart frame members which are set into and extend from the walls of the concrete trench. In order to stabilize the grate and to prevent the grate from rocking when weight, such as from a passing vehicle, is applied thereto, the frame members must be aligned in a common plane during the pouring and setting of the concrete about the form. If the frame members and, in turn, the grate are not properly aligned, the grate, the frame members and/or the cementitious trench itself may be damaged by the resulting movement of the grate. Accordingly, the alignment of the frame members in the moldable trench forming composition is important.

Grates are generally formed of a metal and are typically quite heavy. For example, trench grates frequently come in lengths of 0.5 meters and can weigh from 2 kg to over 150 kg. By way of further example, one common trench grate weighs about 25 kg. As such, grates are oftentimes merely set upon the frame members and are held in place by gravity, without utilizing any additional hardware to attach the grate to the frame members. Without any mechanical attachment of the grate to the frame members, the grate can advantageously be readily removed in order to access the trench, such as to clean the trench or remove some object from the trench. Unfortunately, the ease with which the grate can be removed also permits vandals or others to remove the grate, thereby creating an open trench that could be a hazard to individuals, vehicles, or the like. In addition, without any mechanical attachment of the grate to the frame members, the grate may become dislodged with passing vehicle traffic. Furthermore, in instances in which vehicular traffic passes lengthwise along the grate, forces imparted by the vehicles, particularly during braking or acceleration, may push the grate sections toward one end of the trench in the absence of any mechanical attachment of the grate sections to the frame, thereby potentially creating an undesired opening in the trench.

To secure the grate in the frame members, some conventional trench assemblies therefore include threaded bolts that extend vertically through corresponding openings defined by the grate and frame members. Such a design is disclosed in Great Britain Patent 2,234,001, wherein threaded bolts lock the grate to the underlying structure such that it cannot be jarred loose. However, trench assemblies using threaded bolts to secure the grate make the installation and removal of the grate difficult and time consuming. In addition, the rigid attachment of a grate to the underlying structure does not accommodate any differential in the thermal expansion and contraction of the grate and the underlying structure, such as the cementitious material that forms the trench itself. In this regard, metallic grates will expand to a substantially greater degree than the cementitious material that forms the trench as the temperature increases. This difference in expansion can damage the bolts, thereby making it quite difficult to thereafter remove the bolts in order to remove the grate. In fact, the difference in expansion may be so extreme as to actually shear off the bolts in a few instances. More commonly, however, the cyclic nature of thermal expansion and contraction may cause the bolts to loosen and back out, thereby loosening the attachment of the grate to the frame members. Thus, there is a need to provide a trench forming assembly wherein the grate is secured to the frame members, yet can be easily removed in instances in which it is desirable to remove the grate and access the interior of the trench while accommodating differences in the thermal expansion and contraction of the grate and the underlying structure, such as the cementitious material that forms the trench.

SUMMARY OF THE INVENTION

The present invention is directed to an improved trench forming assembly having an improved locking device for attaching and securing a grate over a trench or the like. According to the present invention, a removable pin is slidably positioned through an opening defined by an elongated frame member of the assembly and is engaged by a hook carried by the grate for securing the grate over the trench. Advantageously, while the angled position of the pin securely retains the grate, the pin can be easily removed in instances in which it is desirable to remove the grate and access the interior of the trench.

In particular, an assembly for forming a trench according to one embodiment of the present invention comprises a frame having two elongated members wherein each elongated member comprises an upstanding portion from which a support surface extends. The elongated members also define at least one opening therethrough, which in a preferred embodiment is positioned through a corner defined by the upstanding portion and the support surface. In one embodiment, each elongated member also includes a plurality of fixed pins extending inwardly therefrom and positioned in an alternating fashion with a plurality of openings. The frame also includes a plurality of leg members that are attached to and spaced along the elongated members. The leg members can have various shapes, such as an "L" shape or a "U" shape. In one embodiment, the leg members attach to both elongated members to help stabilize and further secure the elongated members.

The assembly also includes a removable grate that is disposed on the support surface of the elongated members. The grate has an upper surface and at least one hook that is disposed proximate at least one opening of the elongated members. In one advantageous embodiment, the grate defines at least one opening that is aligned with the at least one opening of the elongated members such that the portion of the grate proximate the opening and opposite the upper surface serves as the hook. In one embodiment, the grate comprises a first grate section and a second grate section, each having opposed ends and opposed lengthwise extending sides. Each grate section defines a groove proximate both one side and one end and extending at an acute angle relative to the upper surface. As before, that portion of each grate section proximate the groove and opposite the upper surface serves as a hook. Preferably, each grate section defines openings proximate each side and at each end, each of which extends at an acute angle relative to the upper surface. Advantageously, the grooves of adjacent grate sections are formed such that once the grate sections are placed end to end, the grooves of the adjacent grate sections are aligned, thereby collectively defining a complete opening.

The assembly can also include an end rail that bridges across the trench. The end rail includes an upstanding wall that defines a predetermined angle relative to the upper surface of the grate. In one embodiment in which the grate defines an opening proximate both one side and one end, the end rail also defines an opening proximate a side wall such that when the corresponding openings of the grate and the end rail are aligned they collectively define a complete opening. In this embodiment, the angle defined between the upper surface of the grate and the upstanding wall is about 90°. However, if the end of the grate proximate the end rail does not define an opening, such as if a grate section has been cut to size, the angle defined between the upper surface of the grate and the upstanding wall is preferably an acute angle and the respective end of the grate preferably defines a corresponding obtuse angle relative to the upper surface of the grate such that the respective end of the grate mates with the upstanding wall of the end rail to secure the grate.

The assembly also includes at least one removable pin that is slidably inserted through the respective openings defined by the grate, elongated members, and/or end rails and is mechanically engaged by the hook of the grate to releaseably secure the grate to the frame. The pin is preferably threadless, such as a threadless cylinder, although other designs that can slidably engage the openings can also be used.

Advantageously, the openings defined by the grate, elongated members, and end rails each preferably extend at a predetermined acute angle relative to the upper surface of the grate, such as about 45°, such that the removable pin can be easily removed from the openings if it is desirable to remove the grate. The predetermined angle is selected such that the removable pin at least partially held within the openings by gravitational forces so that the pin cannot readily be jostled or vibrated from the openings, while still being capable of being easily removed by hand, if desired. In addition, the grate is preferably sized to account for the differences in the thermal expansion and contraction of the grate and the cementitious material that forms the trench so that the pin continues to secure the grate to the frame as the grate and the cementitious material differentially expand and contract, and so that the pin does not become bound within a respective opening or broken by thermal expansion and can continue to be inserted and removed as the temperature changes.

According to one embodiment of the present invention, the assembly includes at least one sleeve member that is secured to a respective elongated member. Preferably, the sleeve member includes a tubular member defining a passageway that is aligned with a respective opening defined by the elongated member, such that a removable pin can be slidably inserted in the passageway to secure the grate. In particular, the tubular member includes an inwardly extending portion that extends through the respective opening defined by the elongated member, and an outwardly extending portion that extends away from the elongated member. The sleeve member also includes an outwardly extending fin that extends along the upstanding portion of the elongated member and defines a groove for receiving a cross tie or tie element that extends across the elongated members to bias the elongated members toward one another. In one embodiment, the sleeve member is connected to a leg member, so that leg member is connected to the elongated rail by way of the sleeve member.

Methods of forming a trench according to the present invention are also provided. In one embodiment, the method of forming a trench includes providing a form assembly comprising a frame as discussed above and a removable form engaged by the elongated members of the frame that defines the predetermined shape of the trench. The form assembly is positioned in the ditch, such as by securing the elongated members to a support frame or attachment using nails, tie wires, or the like, so that the form assembly is aligned in a fixed position. In one embodiment, the leg members of the form assembly are first secured by pouring a sufficient amount of a moldable trench forming composition, such as concrete or similar cementitious material, into the ditch. The moldable trench forming composition is then poured around the removable form and the composition sets around the form assembly to form the shape of the trench. After the trench has set, the form is removed.

A grate having at least one hook is then positioned on the support surface of the elongated members. Advantageously, the grate is releaseably secured to the elongated members by the pin that is slidably and removably inserted into a corresponding opening defined by the elongated member at a predetermined acute angle relative to the upper surface of the grate so as to also be mechanically engaged by the hook of the grate. In one embodiment, the pin also extends through a passageway defined by a sleeve member that is aligned with and is preferentially disposed within the opening defined by the elongated member. The pin is therefore positioned at a predetermined angle of less than 90° relative to the upper surface of the grate, and preferably about 45° relative to the upper surface of the grate.

In one embodiment, each elongated member defines a plurality of openings spaced therealong and includes a plurality of fixed pins extending inwardly therefrom that are positioned in an alternating fashion with the plurality of openings. To position a grate formed of multiple grate sections on the support surface of the elongated members, one end of each grate section is abutted against a respective fixed pin and thereafter the grate sections are placed upon the support surface. According to one embodiment of the present invention, each grate section defines at least one groove such that the portion of the grate section proximate the groove and opposite the upper surface of the grate forms the hook. In this embodiment, as the grate sections are laid down upon the support surface, the respective grooves defined therein are aligned to form a complete opening that is, in turn, aligned with a respective opening defined by the elongated member and, according to one embodiment, with the passageway defined by the sleeve member. By inserting a removable pin therethrough, the hooks of both adjacent grate sections engage the pin, thereby securing the grate sections to the frame.

Accordingly, the various embodiments of the present invention provide an important advancement in the state of the art by providing an improved system for securing a grate to the trench that is less difficult and time consuming compared to conventional systems. In particular, the slidably removable pin is capable of securing the grate when inserted in the corresponding opening defined by an elongated member and engaged by the hook carried by the grate, yet can be easily withdrawn from the openings such that the grate can be removed from the trench. In addition, the assembly advantageously accommodates differential expansions and contractions of the grate and the cementitious material that forms the trench. Moreover, the assembly restrains the grate from longitudinal movement otherwise caused by longitudinally directed forces, such as those forces created by the braking and acceleration of vehicles passing in a longitudinal direction along the grate.

BRIEF DESCRIPTION OF THE DRAWINGS

Figure 1:
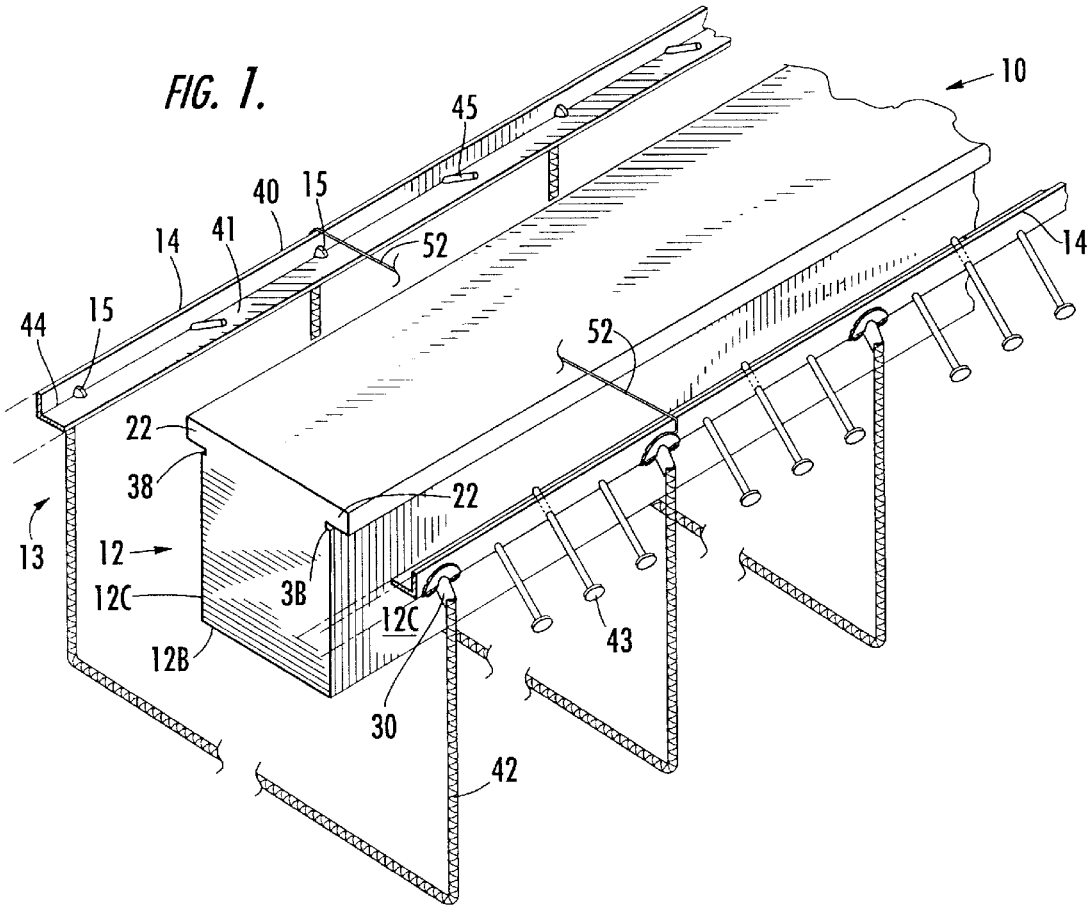
Figure 2:
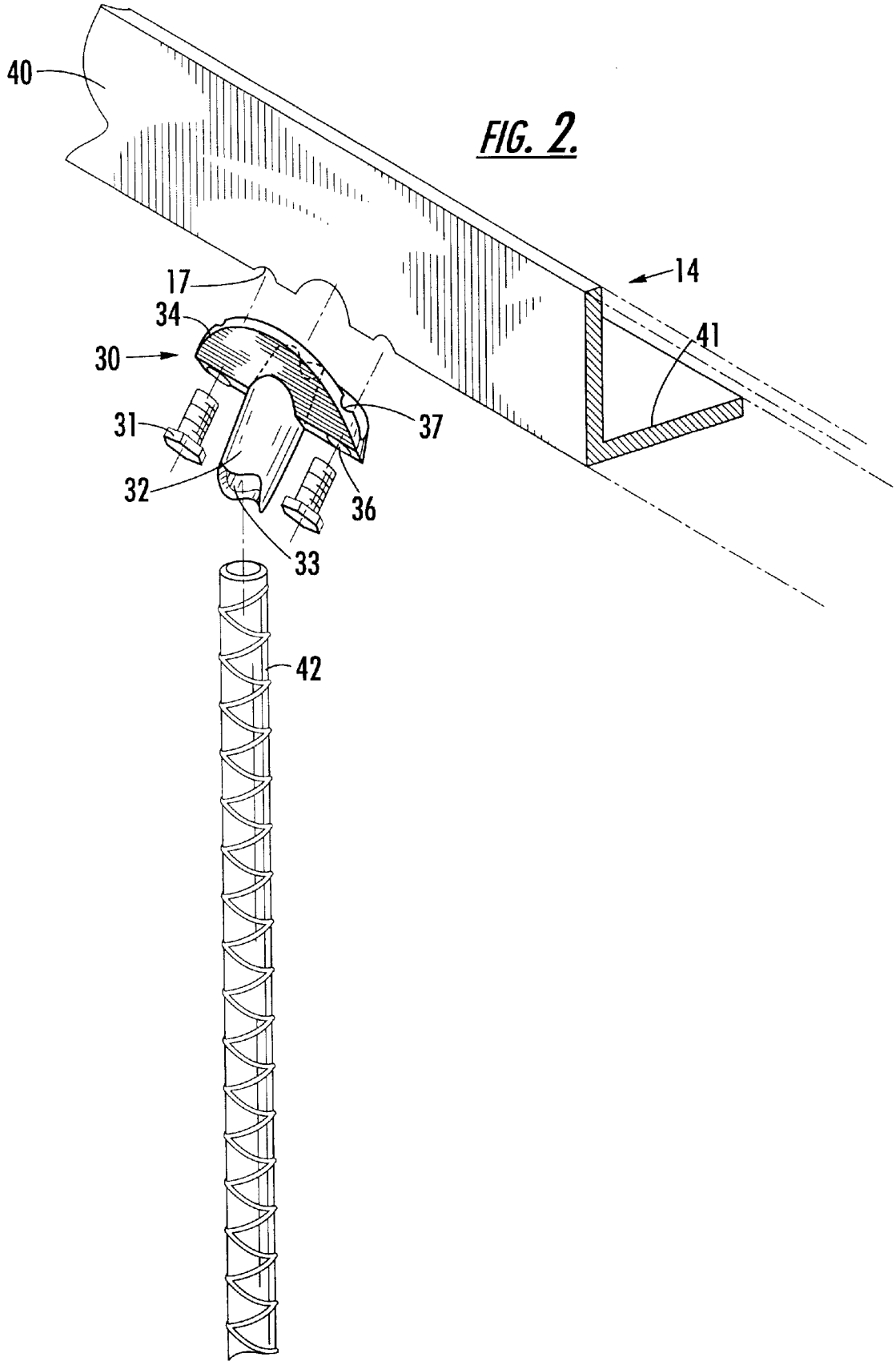
Figure 3:
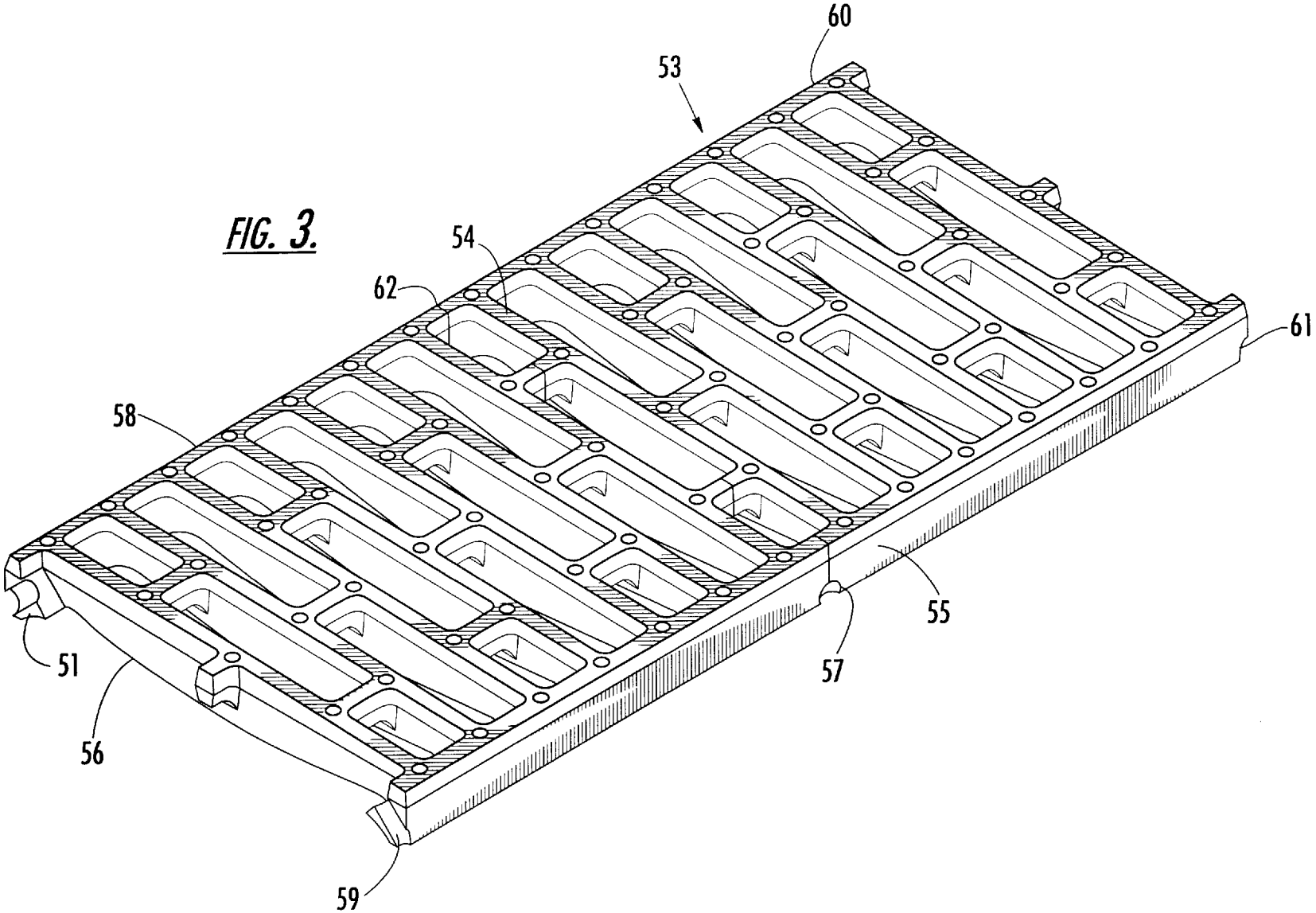
Figure 4:
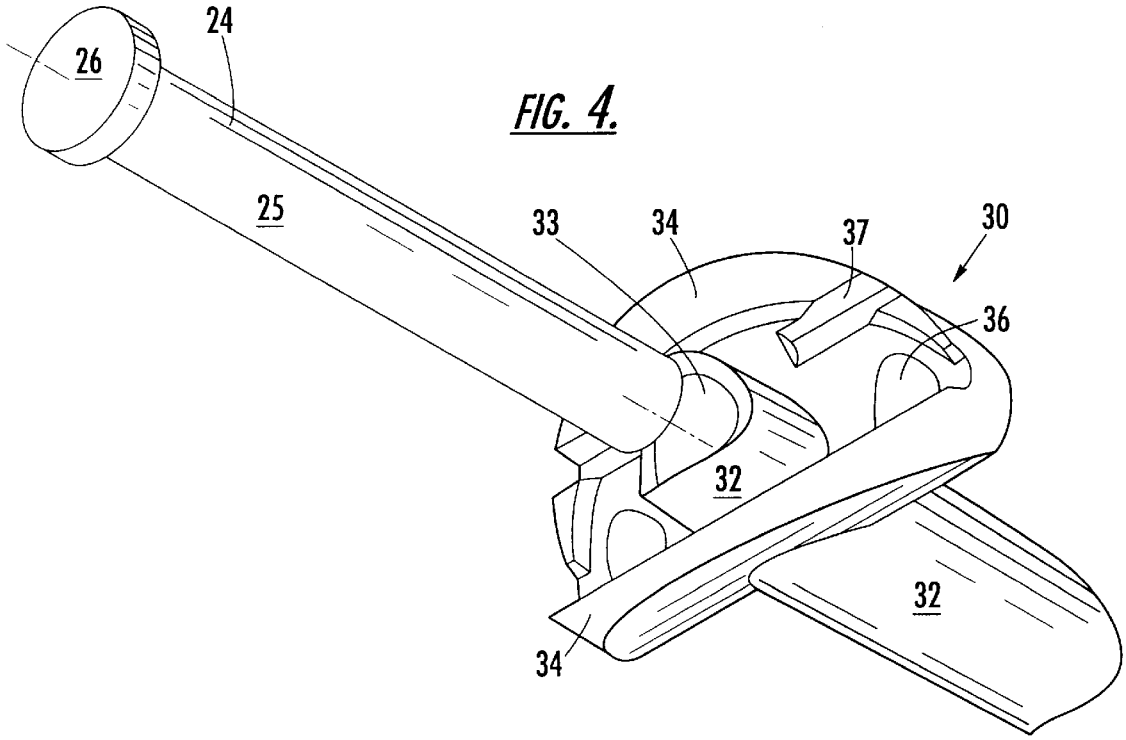
Figure 5:
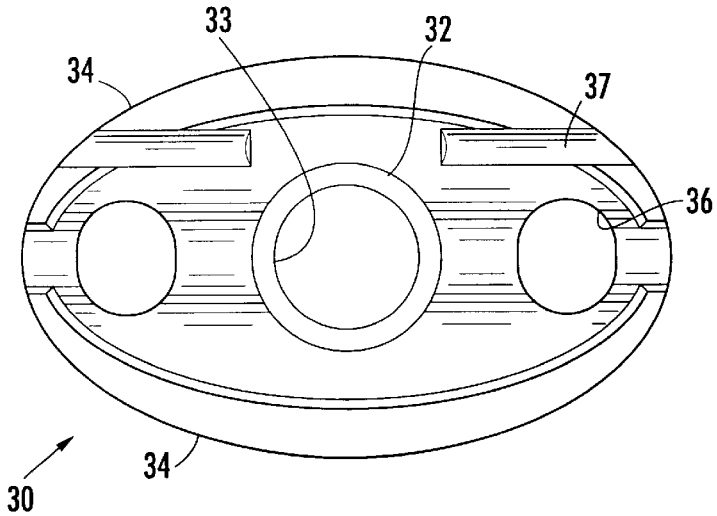
Figure 6:
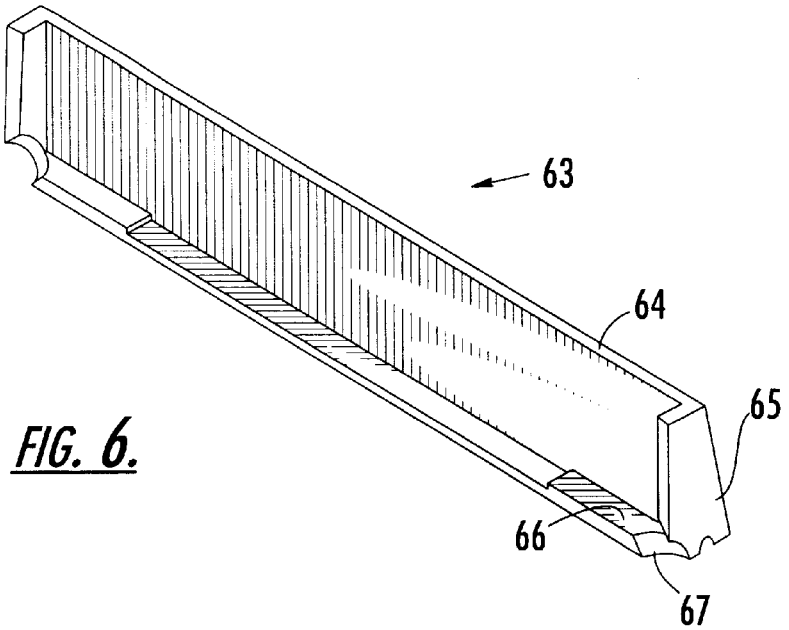
Figure 7:
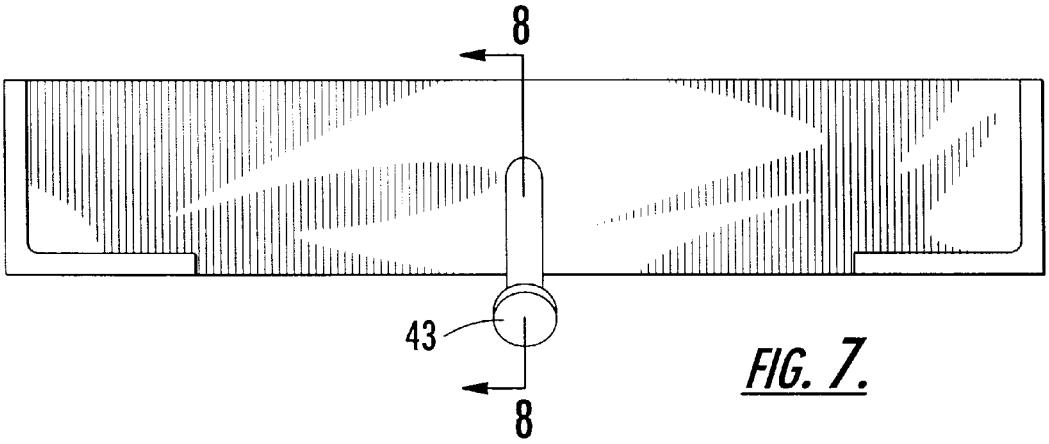
Figure 8:
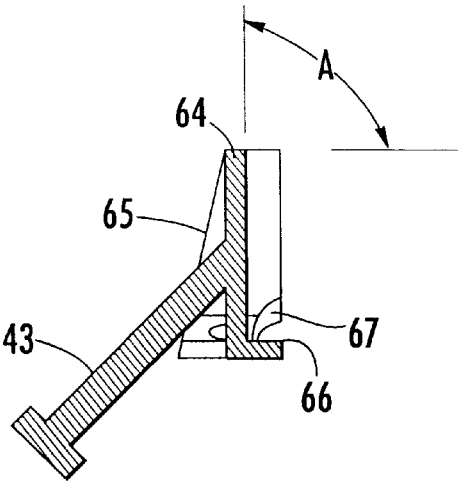
Figure 18:
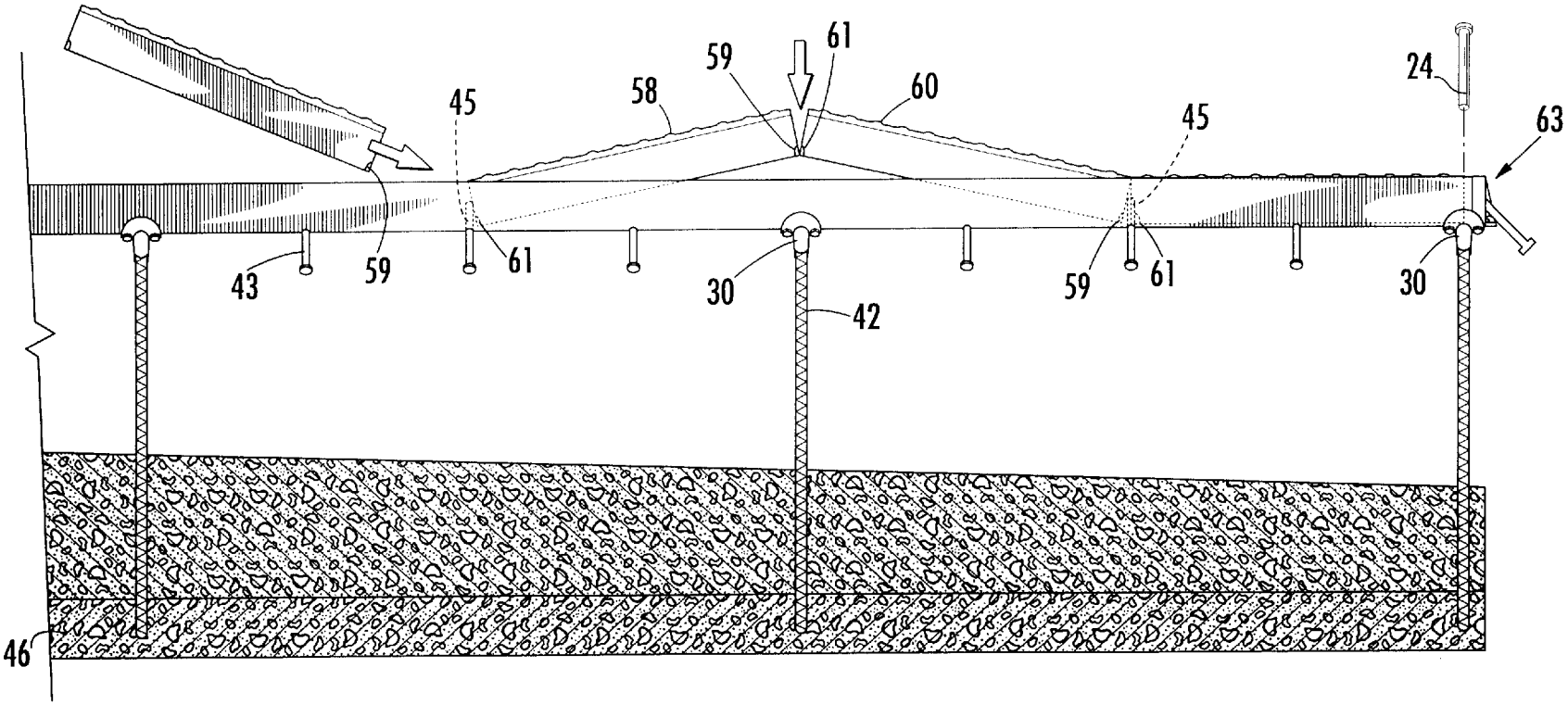
Figure 19:
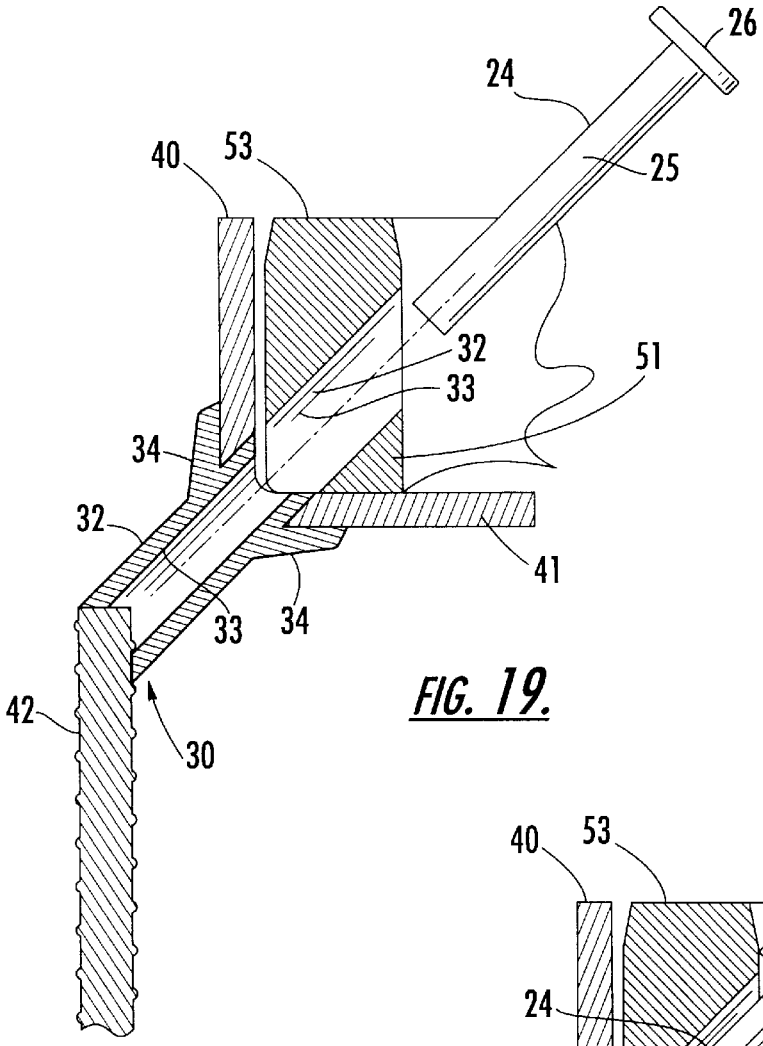
Figure 20:
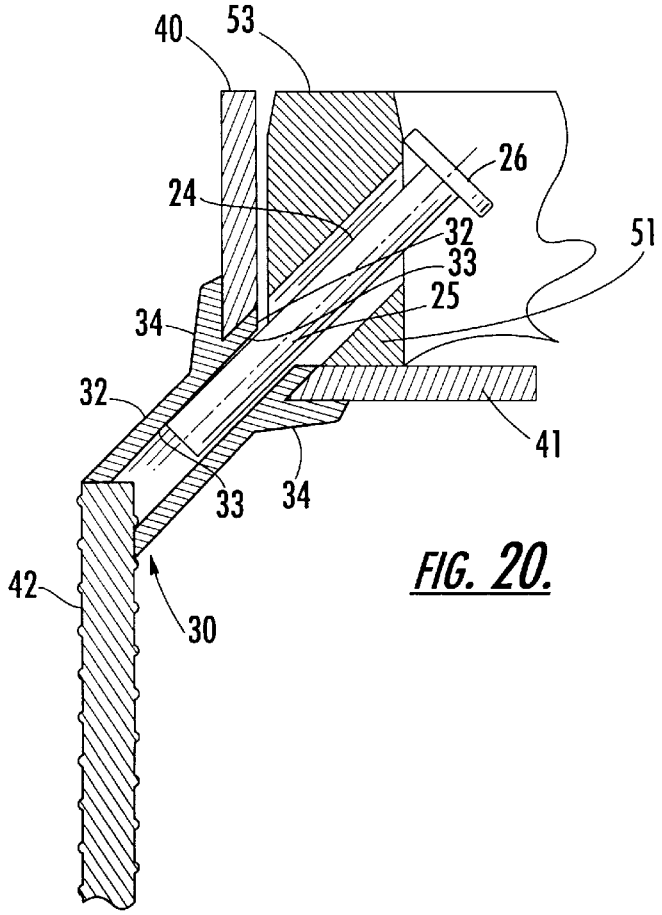

Having thus described the invention in general terms, reference will now be made to the accompanying drawings, which are not necessarily drawn to scale, and wherein:

FIG. 1 is a perspective view of a trench forming assembly according to one embodiment of the present invention;

FIG. 2 is a greatly enlarged exploded perspective view of a portion of a trench forming assembly according to one embodiment of the present invention;

FIG. 3 is a perspective view of a grate of a trench forming assembly according to one embodiment of the present invention;

FIG. 4 is an enlarged sectional view of a sleeve member and a removable pin according to one embodiment of the present invention;

FIG. 5 is an end view of the sleeve member shown in FIG. 4;

FIG. 6 is a perspective view of an end rail according to one embodiment of the present invention;

FIG. 7 is an end view of the end rail shown in FIG. 6;

FIG. 8 is a cross-sectional view of the end rail as seen along lines 8—8 of FIG. 7;

FIG. 9 is a perspective view of an end rail according to one embodiment of the present invention;

FIG. 10 is an end view of the end rail shown in FIG. 9;

FIG. 11 is a cross-sectional view of the end rail as seen along lines 11—11 of FIG. 10;

FIGS. 12–17 show a process of forming a trench according to one embodiment of the present invention;

FIG. 18 shows a side view of a grate positioning step according to one embodiment of the present invention;

FIG. 19 shows a cross-sectional view of a pin before being slidably inserted into openings defined by a grate, elongated member, and sleeve member; and FIG. 20 shows a cross-sectional view of the pin shown in FIG. 19 after being slidably inserted into the openings defined by the grate, elongated member, and sleeve member.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1–3 illustrate an assembly 10 for forming a trench of a predetermined shape. The trench forming assembly 10 includes a frame 13 having a pair of elongated frame members 14. The elongated members 14, which are preferably formed of L-shaped iron or similar rigid material, each define an upstanding portion 40 and a support surface 41 extending therefrom. While the elongated members can be formed in various manners, the upstanding portion 40 and support surface 41 preferably define a corner 44 having a corresponding angle, such as about 90°. The elongated members are preferably disposed in parallel and are positioned such that the support surfaces 41 extend inwardly toward one another. The support surfaces are therefore adapted to engage and support a grate once the trench has been formed, as discussed below. The elongated members 14 also define at least one opening 15 therethrough. The opening 15 preferably extends through the corner 44, although the opening can also extend through either the upstanding portion 40 or the support surface 41, as discussed more fully below.

The assembly 10 also includes a plurality of anchoring legs 42, typically formed of rebar, that are connected to and extend from the elongated member 14. As discussed below, the plurality of anchoring legs 42 are adapted to anchor the assembly 10 in a subslab 46 of moldable trench forming composition poured around the anchoring legs during formation of the trench. In one advantageous embodiment, the anchoring legs 42 preferably have a U-shaped configuration such that a single anchoring leg 42 attaches to both of the elongated members 14. As such, the anchoring legs serve to align and position the elongated members relative to one another, in addition to facilitating anchoring of the frame. Other configurations of anchoring legs are also possible, such as substantially linear anchoring legs having relatively small hooks, feet or the like.

The elongated members 14 also preferably include a plurality of anchors 43 extending outwardly at an angle relative to the support surface 41, such as at about 45°. The anchors 43 are adapted to extend into and be engaged by the hardenable trench forming composition so that the anchors 43 facilitate the retention of the opposing elongated members 14 within the trench formed of hardenable trench forming composition. As illustrated, the anchors typically extend outwardly from the corner 44 of each elongated member. However, the anchors can extend outwardly from other portions of the elongated member, if so desired.

As described in detail below, the resulting trench will be covered by a grate which will be at least partially retained by removable pins, each of which extends through an opening 15 defined by an elongated member 14 and is engaged by a hook carried by the grate, thereby mechanically coupling the grate and the frame 13. Preferably, the pin also extends through the opening 15 defined by an elongated member 14 and into a corresponding void defined by the trench forming composition. While the void can be defined by a sleeve member as described hereinafter, the void can be formed in other manners without departing from the spirit and scope of the present invention. For example, the form described below that defines the shape of the trench can include outward projections designed to extend through respective openings 15 defined by the elongated members 14 to thereby define voids in the trench forming composition.

In one advantageous embodiment, however, the assembly 10 also includes at least one and preferably a plurality of sleeve members 30 that are connected to the elongated members 14, preferably on the outside of the elongated members as shown in FIGS. 1 and 2. The sleeve member 30 includes a tubular member 32 defining a passageway 33. Each sleeve member 30 is connected to an elongated member 14 such that the passageway 33 is aligned with a respective opening defined by the elongated member. Preferably, the tubular member is adapted to be aligned with and received by the opening 15 defined by the corresponding elongated member 14 such that the tubular member 32 includes a first portion that extends through the opening 15. As shown in FIGS. 1 and 2, for example, the sleeve member 30 is attached to the elongated member 14 such that the first portion 32 extends inwardly through an opening defined in the corner 44 of the elongated member. Preferably, the first portion extends through the opening defined by the elongated member so as to be flush with the interior surface of the elongated member as shown in FIGS. 19 and 20 or to be somewhat recessed within the opening defined by the elongated member. The tubular member 32 also includes a second portion that extends outwardly away from the elongated member a predetermined distance.

As shown in more detail in FIGS. 4 and 5, the sleeve member 30 of the illustrated embodiment includes at least one fin 34 adapted to extend along the upstanding portion 40 of the elongated member 14. The fin 34 extending along the upstanding portion 40 defines a groove 37 extending lengthwise for receiving a cross tie, as discussed below. Preferably, the sleeve member 30 includes a pair of fins 34 that define an angle therebetween corresponding to the angle defined by the corner 44 of the elongated member 14. For example, the sleeve member can include a first fin that extends along the upstanding portion 40 of the elongated member 14 and a second fin that extends along the support surface 41 and that is disposed at an angle of about 90° relative to the first fin. As such, the fins of the sleeve member permit the sleeve member to structurally engage the respective elongated member and be aligned therewith. The sleeve member can be attached to the respective elongated member in various manners, but, in one embodiment, the sleeve member 30 defines a pair of mounting holes 36 that correspond with a pair of holes 17 defined by the elongated member 14 for receiving a pair of bolts 31 to secure the sleeve member to the elongated member. Other methods of securing the sleeve member 30 to the elongated member 14 can also be used, such as welding or the like. If desired, the anchoring leg 42 can be attached to the sleeve member 30 and, in particular, the distal end of the outwardly extending second portion of the sleeve member, such as by welding, although this is not required.

The assembly 10 also includes a removable grate 53 that is supported by the support surface 41 of the elongated members 14. The grate 53, which can be made from a range of materials, such as metals, polymers, carbon fiber, and the like, includes an upper surface 54 and opposing side walls 55 and end walls 56. The grate 53 also includes at least one hook 51 proximate one end and one side thereof. In the illustrated embodiment, the grate 53 defines at least one opening 57 such that the hook is formed by the material proximate the opening on the lower side thereof, i.e., opposite the upper surface 54 of the grate. Although the hook can be formed in other manners without departing from the spirit and scope of the present invention, a grate defining one or more openings which, in turn, define respective hooks will be hereinafter described for purposes of explanation, but not of limitation. For rectangular grates, the grate more typically defines four openings and, in turn, four hooks, one of which is proximate each corner of the grate. In the illustrated embodiment, the grate can therefore be positioned upon the support surface of the elongated member so that at least some of the openings defined by the grate are aligned with corresponding openings 15 defined by the elongated members 14 and the passageways 33 defined by the tubular portion 32 of the sleeve members 30 that are coextensive with the openings defined by the elongated members. A grate could define complete openings with the material proximate the lower portion of each opening forming a hook. However, for a grate formed of a number of grate sections, the openings defined by each grate section are preferably grooves opening through the end wall of the grate that define about 180° or less of a complete opening. By defining the openings to be of the same size and shape and in the same relative location for each grate section, more complete openings can be defined by abutting the end walls of adjacent grate sections such that corresponding pairs of the grooves defined by the adjacent grate sections are aligned.

According to one advantageous embodiment of the present invention, a removable pin 24 is adapted to be slidably inserted in corresponding openings defined by the grate 53, elongated member 14, and sleeve member 30 to secure the grate 53 to the trench, and more specifically to the respective elongated member of the assembly 10. The pin 24 has a body or shaft 25 that is preferably threadless, and in one embodiment includes a head 26 so that the pin can be easily grasped. While the head can be configured as shown in FIG. 4, the pin may, instead, be a hitch pin having an angled end portion that can be grasped to remove the pin. Alternatively, the pin can contain cotter pin holes proximate one or both ends such that the pin cannot be removed as readily, but can be removed by a cotter pin puller, if so desired. For security reasons or the like, however, such as to prevent the pin 24 from being withdrawn by vandals or unauthorized persons, the pin 24 may only include the shaft 25 so that the pin cannot be readily removed. Even the headless pin can be removed, however, such as by contacting the exposed end of the pin with a welding rod or the like. As described below, the assembly is designed such that the pin secures the grate to the frame and, in particular, to the elongated members, thereby preventing the grate from substantial movement relative to the frame and from being inadvertently dislodged from the frame. However, the pin can be withdrawn in order to remove the grate and access the trench, such as for cleaning or other purposes.

Advantageously, the openings 57, 15, 33 of the grate 53, elongated member 14, and sleeve member 30, respectively, are aligned in a predetermined acute angle, such as about 45°, relative to the upper surface 54 of the grate 53, so that the mechanical engagement of the pin 24 and the hook 51 retains the grate and prevents the grate from being lifted from the trench without first removing the pin, even though the pin does not threadably engage the frame. Thus, the pin can be more quickly installed and removed than threaded connectors which may also become corroded over time and, as such, even more difficult to remove. In particular, the pin 24 is positioned at an acute angle, which can vary according to the positioning of the trench, such that the pin is at least partially held within the openings by gravitational forces so that the pin cannot readily by jostled or vibrated from the openings. For example, if a grate were positioned horizontally, placing the pin substantially vertical would allow gravitational forces to act on the pin. However, the grate could disadvantageously be lifted from the frame without first removing the pins by merely lifting the grate vertically upward. On the other hand, placing the pin in a substantially horizontal orientation would prevent the grate from being removed without first removing the pins, but the pin would not be held in the respective openings by gravitational forces. As a result, the pin could vibrate loose. Thus, an acute angle between vertical and horizontal (for a horizontally mounted grate), such as about 45° relative to the upper surface of the grate, is preferable to allow for both gravitational forces and frictional forces (from the weight of the grate against the pin) to hold the pin within the openings and to prevent the grate from being removed without first removing the pins.

As discussed above, the grate 53 extends along and rests upon the support surfaces 41 of the elongated members 14 to span the trench. For trenches that extend a relatively great distance, such as a trench extending across a commercial aircraft runway, it is desirable to divide the grate 53 into sections so that only a portion of the grate need be removed in order to access a portion of the trench and to reduce the weight of each individual grate section. In this regard, the grate 53 is typically divided into a plurality of grate sections including at least a first grate section 58 and a second grate section 60 that are positioned adjacent one another in an end-to-end relationship. As described above, each grate section of one embodiment includes a hook 51 defined by partial openings or grooves 59, 61 positioned proximate both one side and one end. The grooves 59, 61 are positioned so that when adjacent first and second grate sections 58 and 60 are positioned end to end, the grooves 59, 61 align to collectively define a complete opening, such as the opening 57, that is aligned with respective openings of the elongated member 14 and sleeve member 30. As described below, a removable pin can then be inserted through the aligned openings in order to retain the grate in position upon the frame.

Turning now to FIGS. 6–11, the assembly 10 also includes end rails 63 bridging between the elongated members 14 at opposed ends of the trench. Each end rail includes an upstanding wall 64 and substantially perpendicular side walls 65. Although not necessary for the practice of the present invention, each end rail of the illustrated embodiment also includes a surface 66 that extends from the upstanding wall 64. The surface 66 can serve as a filler to restrain the trench forming composition as it is poured and hardens about the form as described below. The upstanding wall defines a predetermined angle A with respect to the upper surface 54 of the grate 53 In one embodiment shown in FIGS. 6–8 in which the predetermined angle A between the upstanding wall 64 and the upper surface 54 of the grate 53 is about 90°, the end rail 63 defines at least one opening, such as at least one groove 67, extending through both the side wall 65 and surface 66. More preferably, the end rail of this embodiment defines at least one and preferably a pair of openings, i.e., grooves; one of which is at least partially defined by each side wall of the end rail. Advantageously, the grooves 67 defined by the end rail 63 are adapted to align with the grooves 59 defined by the end wall 56 of a grate section 58 such that the grooves 67, 59 collectively define a pair of complete openings adapted to slidably receive removable pins 24 in the same manner described above. Typically, the end rail depicted in FIGS. 6–8 and described above is employed in circumstances in which the trench ends with a complete grate section such that the end wall of the grate section includes corresponding grooves for cooperating with the grooves defined by the end rail to define complete openings.

If, on the other hand, the trench is sized such that the endmost grate section 58 must be cut to size, the end wall of the grate section will typically no longer define one or more grooves 59 since the portion of the grate section that defined the grooves will have been cut and removed. As such, an end rail 63 according to another embodiment of the present invention is provided as shown in FIGS. 9–11 to secure the cut end of the grate section to the frame. More specifically, in this embodiment, the cut end 56 of the grate section 58 is formed so that the newly formed end wall and the upper surface 54 of the grate define an obtuse angle therebetween, such as about 100°. Advantageously, the end rail of this embodiment is constructed such that the predetermined angle A defined by the upstanding wall 64 and the upper surface 54 of the grate 53 is an acute angle that is complementary to the obtuse angle defined by the grate section 58, such as about 80°. In other words, the obtuse angle of the cut end of the grate section and the acute angle of the end rail preferably sum to about 180°. As such, the angled upstanding wall of the end rail engages the cut end of the grate section 58 to thereby suitably engage the grate section.

The grate could be secured completely secured to the frame by means of removable pins. For a grate comprised of multiple grate sections, for example, each end of each grate section could be secured to the elongated members by removable pins. In order to further facilitate the installation and removal of the grate sections, however, the elongated members can also include a plurality of fixed pins 45 that extend inwardly from the elongated members. For a grate comprised of a plurality of grate sections of the same length, each elongated member of one advantageous embodiment defines a plurality of openings spaced along the length of the respective elongated member a distance equal to or slightly greater than the combined length of two grate sections. In this embodiment, each elongated member includes a plurality of fixed pins 45 that are arranged in a staggered or alternative fashion relative to the openings along the respective elongated member at the same spacing as the openings. The fixed pins preferably extend inwardly from the elongated member and, most commonly, from the corner of the elongated member at an acute angle matching that of the openings defined by the grate sections 58, 60, elongated members, and sleeve members 30, such as 45° in one embodiment. In this regard, the fixed pins of the illustrated embodiment appear to be coextensive with corresponding anchors 43. However, the fixed pins and the anchors can be located at different positions along the length of an elongated member, if so desired. As described in more detail below, the fixed pins 45 are adapted to be engaged by corresponding hooks 51 of the grate 53 such as by being received in the grooves 59, 61 of the adjacent first and second grate sections 58 and 60 to thereby secure one end of the grate sections while the removable pins secure the other end of the grate sections.

Figure 12:
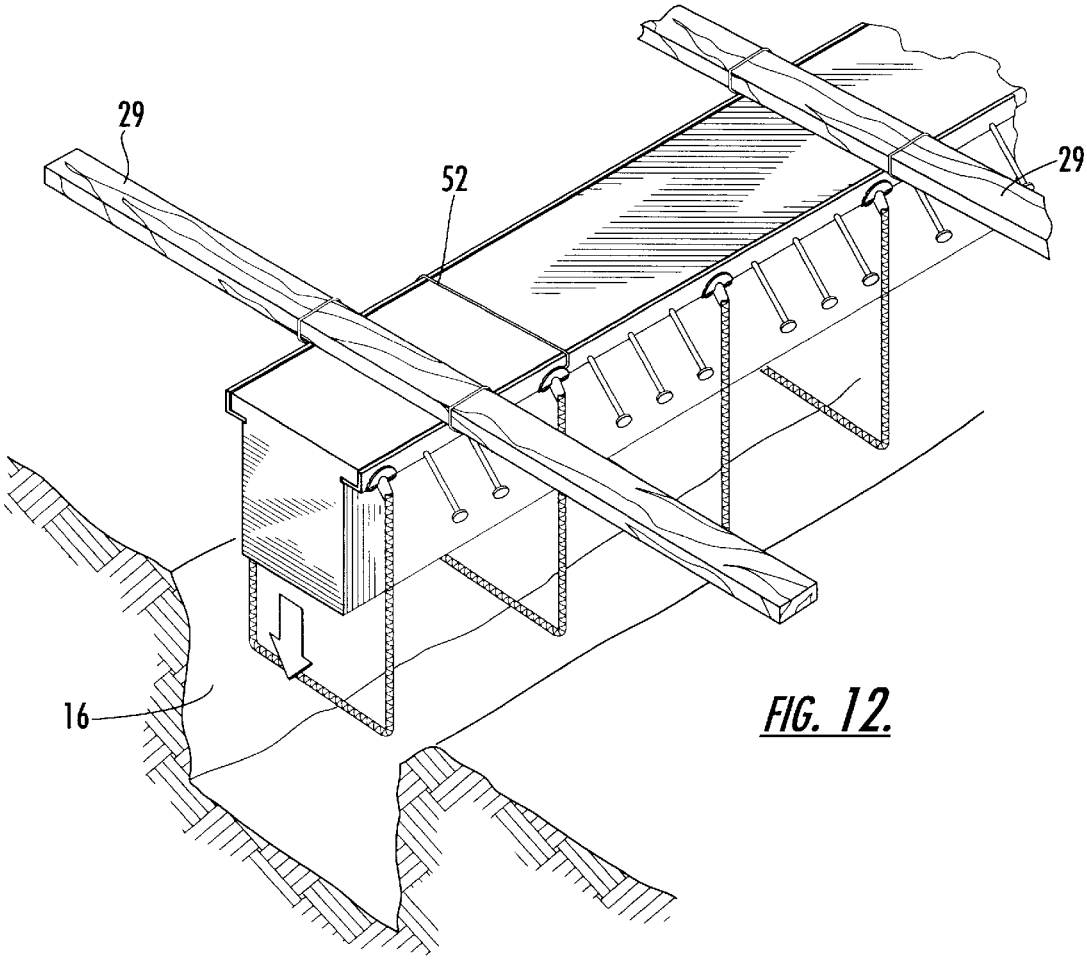
Figure 13:
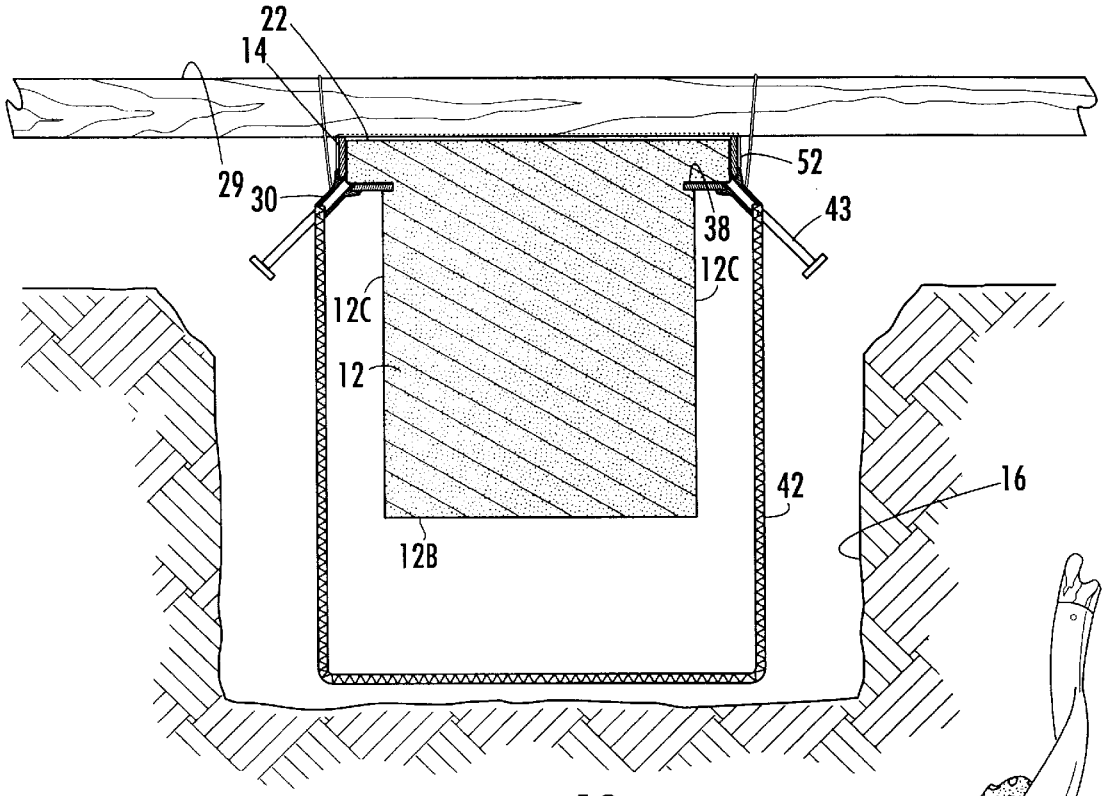

FIGS. 12–17 illustrate use of the trench forming assembly of one embodiment of the present invention. In use, the frame assembly 10 is placed in a predetermined location, such as a preformed ditch 16 as illustrated in FIG. 12. As shown, the frame assembly includes a pair of elongated members, each of which includes a plurality of sleeve members attached thereto in alignment with corresponding openings defined thereby. In addition, each elongated member includes a plurality of fixed pins extending inwardly therefrom and positioned in an alternating fashion with the sleeve members along the length of the elongated member. Anchoring legs 42 are secured to the elongated members 14, preferably via the sleeve members 30. In the illustrated embodiment, the anchoring legs are U-shaped members that are connected to both elongated members. As such, the elongated members are connected via the anchoring legs such that the openings and fixed pins of each elongated member are aligned with corresponding openings and fixed pins of the other elongated member. A removable form 12 is then placed between the elongated members to define the shape of the resulting trench. In particular, the removable form includes a top surface 12A, a bottom surface 12B, and opposed side surfaces 12C for forming a moldable trench forming composition into a trench of predetermined shape. The form 12 can have a variety of shapes, such as having perpendicular bottom and side surfaces forming a rectangular shape or having a rounded surface such that the side surfaces and bottom surface form a semi-circular shape or the like.

In one embodiment, the form 12 defines a pair of coplanar slots 38 at the junction of the opposed tab portions 22 and side surfaces 12C for engaging the elongated frame members 14 and, in particular, the support surfaces 41 of the elongated members. Such engagement slots are discussed in detail in U.S. Pat. No. 5,281,051, which is assigned to the assignee of the present invention and incorporated herein by reference. Various details disclosed in the incorporated patent are not repeated herein for the sake of brevity. However, reference may be had to the incorporated patent for such details. elongated As described by U.S. Pat. No. 5,281,051, the engagement of the elongated frame members 14 with the coplanar slots 38 serves to retain the form 12 in position as the trench forming composition is poured thereabout by counteracting at least some of the buoyancy forces exerted upon the form.

Once the support surfaces 41 of the elongated members have engaged the coplanar slots 38 of the form 12, cross ties 52 are placed over the elongated members 14 and through the grooves 37 defined by the sleeve members 30. In this manner, the elongated members 14 and the form 12 are held together in a fixed position such that they do not move relative to one another.

The assembly 10 is then preferably positioned in the ditch 16. To ensure that the assembly is properly positioned in the ditch 16, a support attachment 29, such as a support lumber piece positioned transverse to the elongated members 14, is attached to the assembly 10 by securing wire or the like about the support attachments and the anchors 43. The support attachment 29 extends beyond the elongated members 14 and is secured to external posts or the like (not shown) outside of the ditch 16 so that the support attachment and assembly 10 can be properly leveled and positioned. As shown in FIG. 12, the assembly is typically attached to a plurality of support attachments positioned along the length of the assembly. In embodiments in which the frame assembly is proximate one or both ends of the trench, end rails 63 as described above are also attached to one or both opposed ends of frame assembly by bolts, welding, or the like. As also described above, the selection of the type of end rail to be utilized depends on whether the trench length permits each grate section to be full length or whether a grate section must be cut to size. In this regard, an end rail having an upstanding wall 64 that is perpendicular to the upper surface 54 of the grate 53 and defining at least one and, more typically, a pair of openings, i.e., grooves, can be utilized if the grate sections will be full length. Thus, the grooves defined by the end rail can cooperate with corresponding grooves defined by the end wall of the grate section to define complete openings for receiving respective pins. Alternatively, an end rail having an upstanding wall at an acute angle relative to the upper surface 54 of the grate 53 can be utilized if a grate section must be cut. Thus, the upstanding wall of the end rail of this embodiment can engage the angled end wall of the grate section to retain the cut end of the grate section in position.

Figure 14:
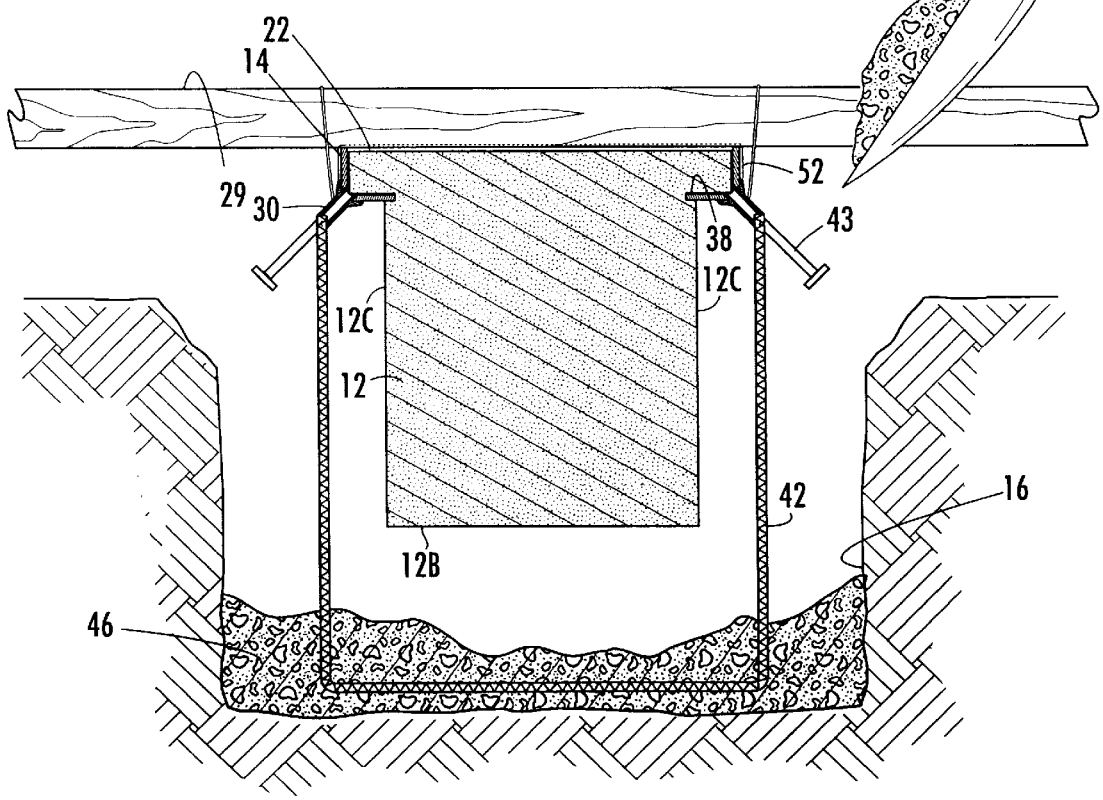

Referring to FIG. 14, the assembly 10 is thereafter anchored in the ditch 16 or location in which a trench is to be formed. Preferably, the assembly 10 is anchored by pouring a subslab 46 of hardenable trench forming composition, such as concrete or other cementitious material, in the ditch 16. The subslab 46 is poured about the leg members 42 and below the bottom surface 12B of the form 12. Once the subslab 46 has hardened or set, the elongated members 14, as well as the removable form 12 that is engagedly retained by the elongated members, are held in a fixed relation within the ditch 16. The support attachments 29 can then be removed, if desired, to permit more open access to the ditch.

Figure 15:
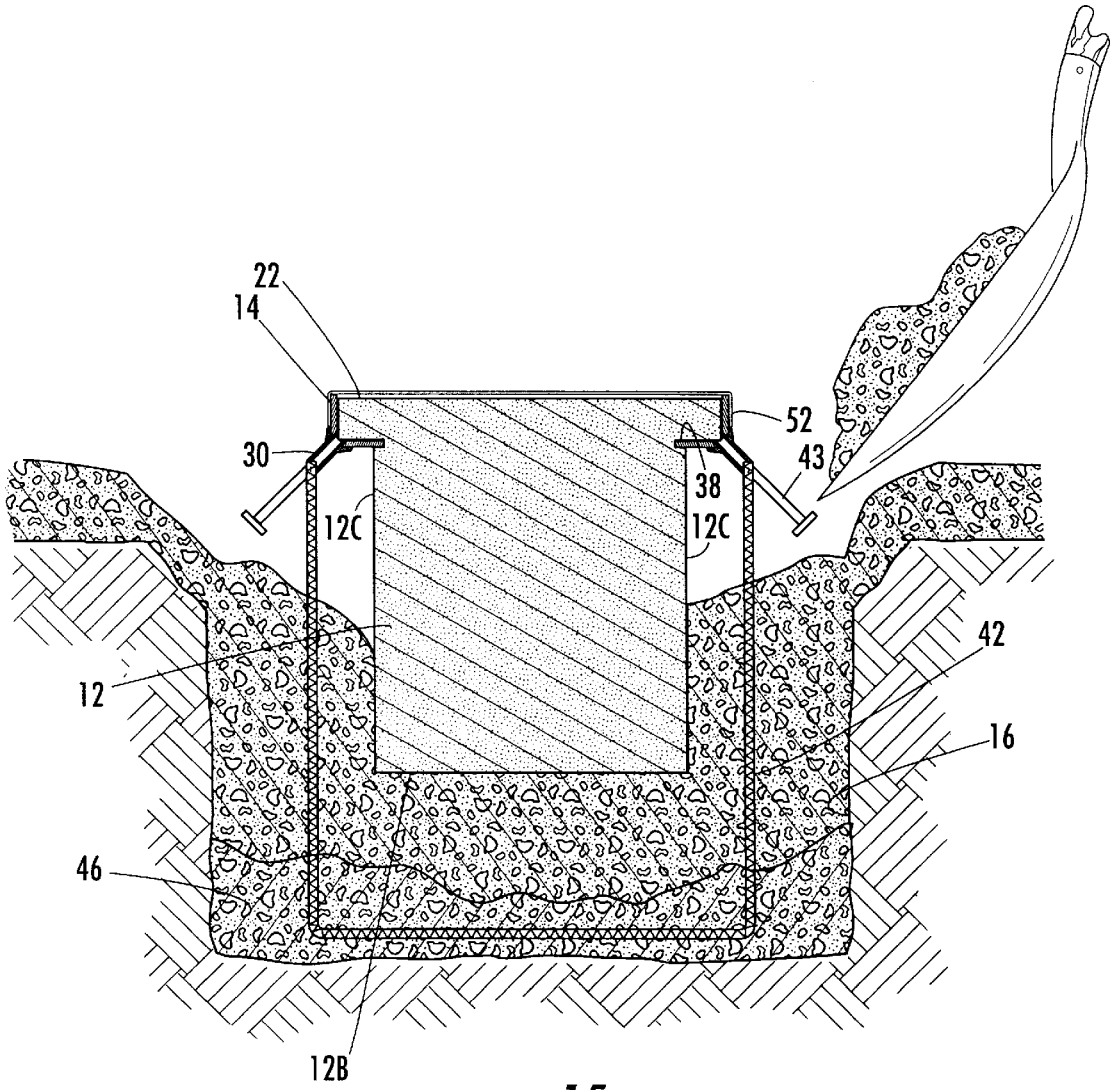
Figure 16:
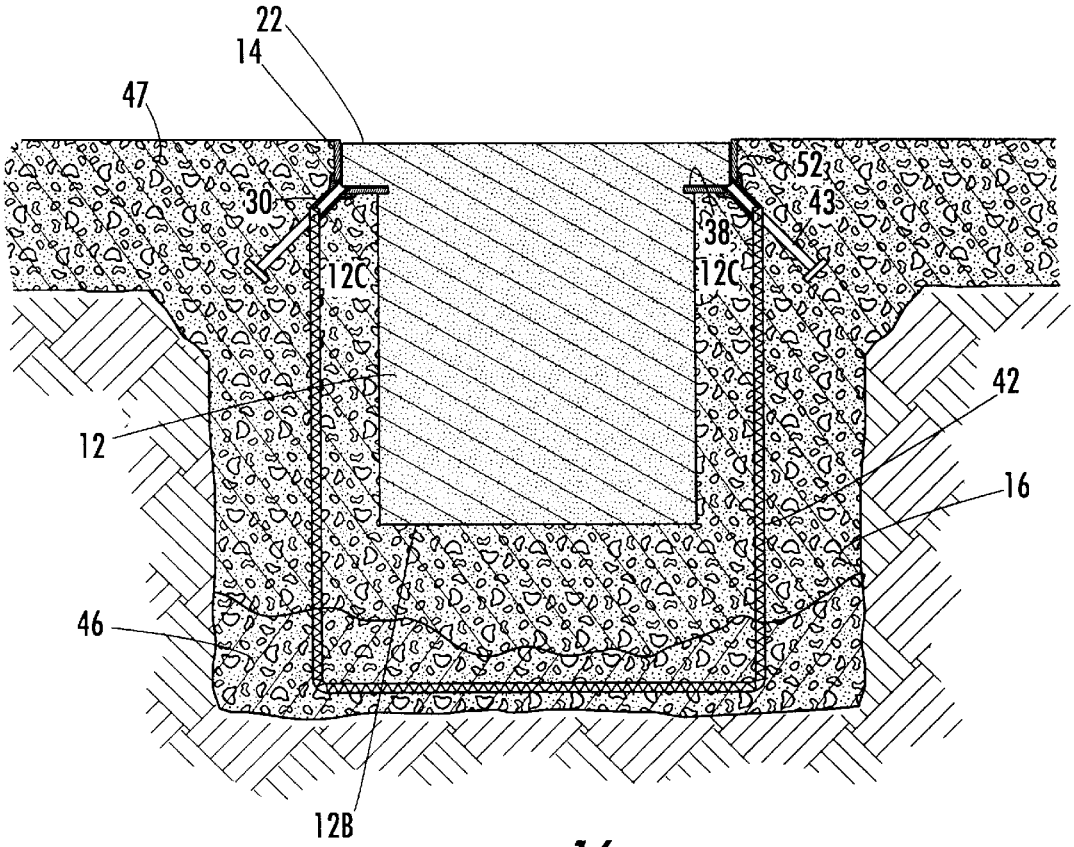

Referring to FIGS. 15 and 16, additional hardenable trench forming composition is poured between the bottom surface 12B and opposed side surfaces 12C of the removable form 12 and the walls of the ditch 16 to form a main slab 47. Preferably, the slab 47 of trench forming composition fills the ditch 16 about the form body 12 up to the uppermost portion of the upstanding portion 40 of the elongated members 14. During the pouring and hardening of the trench forming composition about the bottom surface 12B and opposed side surfaces 12C of the form 12, considerable upwardly directed hydraulic force is exerted by the trench forming composition on the exterior surfaces of the form 12 due to the lower density of the form material. However, due to the subslab 46 that secures the leg members 42 and thus the elongated members 14, the form 12 retains its position during the trench forming process.

Figure 17:
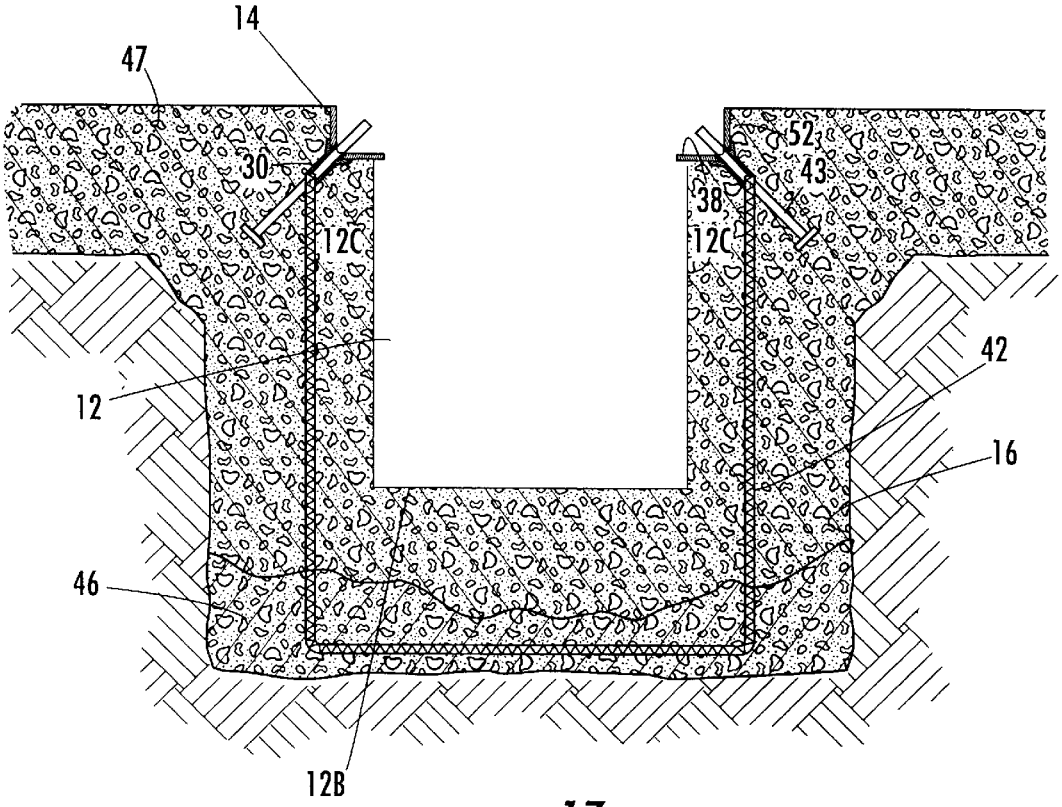

FIG. 17 shows the next step in the trench forming process according to one embodiment of the present invention, wherein the elongated form body 12 is removed from the formed and hardened trench. More particularly, the form 12 is removed by inserting a digging bar or the like at defined places along the form and lifting or prying the form out of the formed trench. While the form 12 may or may not be destroyed during the removal process, the resulting trench defines surfaces similar to the bottom surface 12B and opposed side surfaces 12C of the form.

FIGS. 18–20 show more steps according to one advantageous embodiment of the present invention. Specifically, FIG. 18 shows how a grate 53 may be placed upon the support surfaces 41 defined by the elongated members 14. In a preferred embodiment, the thickness of the grate 53 and the height of the upstanding portion 40 of the elongated members 14 are approximately equal. Thus, by aligning the uppermost portion of the opposing elongated members 14 with the upper surface of the slab 47 of trench forming composition poured about the form assembly 10, the upper surface 54 of the grate 53 lies flush with the surrounding ground or surface defined by the slab 47.

Further, when the grate 53 is properly positioned on the support surfaces 41 of the elongated members 14, the hooks 51 are proximate openings defined by the elongated member. In the illustrated embodiment, for example, the hooks are insured to be proximate openings defined by the elongated member by aligning the openings 57 defined by the grate with corresponding openings defined by the elongated member and preferably the sleeve member 30. A removable pin 24 can then be inserted into each opening to retain the grate. In order to assist in the positioning of the grate sections and to secure retention of the grate sections to the frame, however, the frame assembly can, but need not necessarily, include a plurality of fixed pins extending inwardly from respective elongated members in an alternating fashion with the openings defined by the elongated members along the length of the elongated members. As described above, a fixed pin is longitudinally spaced from the neighboring openings by a length that equals or slightly exceeds the length of a grate section. In order to install the grate, the end wall of a grate section can be abutted against a pair of fixed pins, one of which extends inwardly from each of the elongated members. As such, the fixed pins can be engaged by corresponding hooks 51 of the grate such as by being positioned within respective openings, i.e., grooves, defined by one end wall of the grate section. As illustrated by FIG. 18, the grate section is then laid upon the support surfaces of the elongated members such that the hooks of the other end of the grate section are proximate corresponding openings defined by the elongated members. In the illustrated embodiment, the grate section and, in turn, the hooks carried by the other end of the grate section are positioned relative to the openings defined by the elongated members by aligning the openings, i.e., grooves, defined by the other end of the grate section with corresponding openings defined by the elongated members and the sleeve members mounted thereto. By repeating this process for each grate section, complete openings will be formed by the alignment of the grooves defined by the end walls of adjacent grate sections with fixed pins extending through every second opening and the remainder of the complete openings being aligned with corresponding openings defined by the elongated members. As shown in FIGS. 19 and 20, pins 24 are then slidably inserted into the remainder of the openings such that the mechanical engagement of the hooks 51 and the pins secure the grate 53 to the trench. Advantageously, no tools are needed to insert the pin 24 in order to facilitate installation and removal of the grate.

The spatial arrangement of fixed and removable pins is slightly greater than the length of the grate sections to accommodate differences in the thermal expansion and contraction of the grate sections 58, 60 and the cementitious material forming the trench. In this regard, the assembly is preferably designed so that the fixed and removable pins continue to secure the grate sections to the elongated members 14 of the frame 13 as the grate sections and the cementitious material differentially expand and contract without the pins ever becoming tightly bound within a respective opening. Thus, the pins can continue to be inserted and removed as the temperature changes. Preferably, the spatial arrangement of the fixed and removable pins is selected such that at the coldest temperatures at which the differential contraction between the grate sections and the cementitious material forming the trench is the greatest, the gap between the ends of adjacent grate sections is still less than the diameter of both the fixed pins and the removable pins such that the grate sections will continue to be securely retained to the frame. Moreover, at the hottest temperatures at which the differential expansion between the grate sections and the cementitious material forming the trench is the greatest, the spatial arrangement of the fixed and removable pins is selected such that the grate will not lock the removable pins in place or shear either the fixed or removable pins.

In the case wherein a full size grate section is proximate the end of the trench, an end rail 63 as shown in FIGS. 6–8 extends between the elongated members. As described above, the end rail has an upstanding wall that is substantially perpendicular to the upper surface 54 of the grate 53 and defines a pair of corresponding grooves 67 extending through the side walls 65 and surface 66. Thus, the grooves 59 and 67 of the grate section 58 and end rail 63, respectively, will align to define a complete opening for slidably receiving pins 24 in the same manner as described above in conjunction with a pair of adjacent grate sections. If, on the other hand, the endmost grate section 58 must be cut to size, the end wall of the grate will, in all likelihood, not define a groove 59. However, the end 56 of the grate section is preferably cut at an obtuse angle relative to the upper surface thereof. Thus, the end rail of FIGS. 9–11 can extend between the elongated members for engaging the cut end of the grate section. In this regard, the upstanding wall 64 and upper surface 54 of the grate 53 define a complementary acute angle. Thus, the angled upstanding wall engages the cut end of the grate section to prevent the grate section from being inadvertently removed. Also, because of the complementary acute angle defined by the end rail 63, the cut end 56 of the grate section must be inserted and engaged by the end rail before securing the opposite end of the grate section to the elongated members. Thus, a slidably removable pin 24 is preferably used instead of a fixed pin 45 to engage the opposite end of the grate section.

Thus, the assembly 10 and methods of the present invention provide substantial improvements in the state of the art. In particular, the slidably insertable and removable pins 24 greatly ease the placement and removal of the grate 53, while securely retaining the grate in position while in use. The sleeve members 30 provide a tubular member 32 defining a passageway 33 aligned with and extending through corresponding openings defined by the elongated member 14 and grate 53 to facilitate insertion of the pin 24. In addition, the fixed pins 45 arranged along the elongated members 14 simplify the placement of the grate sections 58, 60, while reducing the overall number of removable pins 24 required to secure the grate sections. The assembly 10 also provides a small gap 62 between the grate sections in order to accommodate for differential thermal expansion and contraction of the grate sections and the underlying portions of the trench, such as the trench forming material, while still securely retaining the grate sections. In addition, the assembly restrains the grate from longitudinal movement otherwise caused by longitudinally directed forces, such as those forces created by the braking and acceleration of vehicles passing in a longitudinal direction along the grate. Moreover, end rails 63 are provided to secure the grate, regardless of whether the trench terminates with a full size grate section or with a grate section that has been cut to size. Accordingly, the assembly 10 and methods of the present invention allow grates to be easily installed or removed without tools, which improves cost while reducing complexity.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, while only two grate sections 58, 60 were described, the assembly 10 may include many more grate sections depending on the length of the trench and the length of the grate sections. In addition, while the term "ditch" is used throughout the description, the assembly 10 can be used in any space where a trench is desired. For example, the assembly 10 may be positioned above ground instead of in a ditch, and the trench forming compound may be poured therearound to build up a surrounding surface about the assembly. Although specific terms are employed herein, they are used in a generic and descriptive sense only and not for purposes of limitation.

That which is claimed:

1. A method of forming a trench of predetermined shape, the method comprising:

providing a form assembly comprising a frame having two elongated members defining a support surface, a plurality of leg members spaced along and attached to the elongated members, and a removable form defining the predetermined shape of the trench and engaged by the elongated members;

positioning the form assembly;

pouring a moldable trench forming composition around the removable form such that the trench forming composition sets around the form assembly to form the trench;

removing the form after the trench forming composition has set;

positioning a grate having an upper surface and a hook on the support surface defined by the elongated members; and releaseably securing the grate by slidably inserting at least one removable pin through a respective opening defined by an elongated member such that the pin is positioned at a predetermined acute angle relative to the upper surface of the grate and is mechanically engaged by the hook of the grate.

2. A method according to claim 1, wherein providing the form assembly includes providing a form assembly further comprising a plurality of sleeve members that are attached to the elongated members, each sleeve member defining a passageway aligned with a respective opening defined by the elongated member.

3. A method according to claim 1, wherein positioning the form assembly includes attaching the removable form to a support attachment for aligning the trench in a fixed position.

4. A method according to claim 1, further comprising securing the elongated members by positioning at least one tie element about the elongated members to substantially prevent movement of the elongated members away from one another.

5. A method according to claim 1, wherein providing the form assembly includes providing a form assembly including at least one end rail bridging between the elongated members.

6. A method according to claim 1, wherein releaseably securing the grate includes slidably inserting at least one removable pin at an angle of about 45° relative to the upper surface of the grate.

7. A method according to claim 1, wherein the grate comprises first and second grate sections that each define respective grooves such that a portion of each grate section proximate the groove and opposite the upper surface of the grate forms the hook, and wherein positioning the grate includes positioning the first and second grate sections such that respective grooves of the first and second grate portions are aligned to collectively define a complete opening aligned with a respective opening of the elongated member.

8. A method according to claim 7, wherein each elongated member defines a plurality of openings spaced therealong, wherein each elongated member further comprises a plurality of fixed pins extending inwardly therefrom and positioned in an alternating fashion with the plurality of openings, and wherein positioning the first and second grate sections comprises abutting one end of each grate section against a respective fixed pin and thereafter placing the first and second grate sections upon the support surface defined by the elongated members such that the complete opening collectively defined by the grooves of the first and second grate sections is aligned with a respective opening of the elongated member.

* * * * *